US006306256B1

(12) United States Patent
Rosengren et al.

(10) Patent No.: US 6,306,256 B1
(45) Date of Patent: Oct. 23, 2001

(54) RETENTION AGENT

(75) Inventors: Bo Rosengren, Ljungbyhed; Ulla Gytel, Helsingborg, both of (SE)

(73) Assignee: Kemira Kemi AB, Helsingborg (SE)

( * ) Notice: Subject to any disclaimer, the term of this patent is extended or adjusted under 35 U.S.C. 154(b) by 0 days.

(21) Appl. No.: 09/477,627

(22) Filed: Jan. 4, 2000

Related U.S. Application Data

(63) Continuation of application No. PCT/SE98/01233, filed on Jun. 25, 1998.

(30) Foreign Application Priority Data

Jul. 7, 1997 (SE) ..... 9702614

(51) Int. Cl.[7] ..... D21H 21/10

(52) U.S. Cl. ..... 162/164.1; 162/164.3; 162/164.6; 162/165; 162/168.1; 162/183

(58) Field of Search ..... 162/164.1, 164.3, 162/164.6, 168.1, 183, 165

(56) References Cited

U.S. PATENT DOCUMENTS

| | | |
|---|---|---|
| 4,070,236 | 1/1978 | Carrard et al. . |
| 5,516,405 | 5/1996 | De Witt . |

FOREIGN PATENT DOCUMENTS

| | | |
|---|---|---|
| 1004782 | 2/1977 | (CA) . |
| 8604975-6 | 5/1988 | (SE) . |
| 9315271 | 8/1993 | (WO) . |
| 9417243 | 8/1994 | (WO) . |
| 9521296 | 8/1995 | (WO) . |

OTHER PUBLICATIONS

"Charge Titration for Selection and Dosage of Flocculants" by Lydia Bley, 3/94, Mutek Application 1501–e, pp.1–13.

File WPI, Derwent accession No. 88–210940, Berol Kemi AB, Abstract of SE8

A. Knop et al, Phenolic Resins, 9 modified and Thermal–Resistant Resins, pp. 152–155,

*Primary Examiner*—Peter Chin

(74) *Attorney, Agent, or Firm*—Birch, Stewart, Kolasch & Birch, LLP

(57) ABSTRACT

A method and an agent for improving the retention when dewatering a cellulosic fiber suspension are disclosed In the method, there is added to the suspension a retention agent containing a phenol-formaldehyde resin and a polyethylene oxide, and the method is characterised in that a modified phenol-formaldehyde resin containing cationic groups is added to the suspension. The modified phenol-formaldehyde resin preferably has a cationicity of about 5–85% and the cationic groups preferably consist of amine groups. The polyethylene oxide in the retention agent preferably has a molecular weight of about $0.5–20\times10^6$. The modified phenol-formaldehyde resin and the polyethylene oxide are preferably added to the suspension in a weight ratio of modified phenol-formaldehyde resin:polyethylene oxide of from 1:5 to 50:1, and the amount of polyethylene oxide added preferably is about 10–1000 ppm, based on tie dry solids content of the suspension. Preferably first the modified phenol-formaldehyde resin is added to the suspension and then the polyethylene oxide.

14 Claims, No Drawings

RETENTION AGENT

This application is a Continuation of PCT International Application No. PCT/SE98/01233 filed on Jun. 25, 1998, which designated the United States and on which priority is claimed under 35 U.S.C. § 120, the entire contents of which are hereby incorporated by reference.

FIELD OF THE INVENTION

This invention relates to a retention agent, more specifically to a method of improving the retention when dewatering a cellulosic fibre suspension and to a retention agent therefor.

BACKGROUND ART

When dewatering cellulosic fibre suspensions, such as in papermaking, it is desirable that as much as possible of the fibres and the additives such as filler, e.g. calcium carbonate, clay, titanium dioxide and the like, be retained in the dewatered product, i.e. the sheet of paper. To this end, it is known to add to the cellulosic fibre suspension (stock) a retention agent which improves the retention, i.e. increases the amount of solid substance, such as filler in the finished paper compared with the case where no retention agent is added.

With a view to improving the retention in the dewatering of cellulosic fibre suspensions, it is disclosed in CA 1,044,782 to use a combination of a phenol-formaldehyde resin and a polyethylene oxide. Moreover, it is disclosed in SE 8604975-6 to improve the retention by adding a phenol-formaldehyde resin and a high-molecular polyethylene oxide in combination with a cationic starch derivative or a cationic cellulose derivative. Finally, it is also disclosed in U.S. Pat. No. 5,516,405 to improve the filler retention in the dewatering of a pulp slurry by adding a cationic fixative, a promoter and a polyethylene oxide. The cationic fixative is selected from the group consisting of polyethylene amides, polydiallyldimethyl ammonium chlorides and polyethylene imines. The promoter can be selected from the group consisting of phenol formaldehyde, naphthalene sulphonate and black liquor.

Even if the retention is improved by using a combination of phenol-formaldehyde resin and polyethylene oxide as retention agent, there is a need of retention agents and methods which result in additionally improved retention. The above-mentioned U.S. Pat. No. 5,516,405 is an example of an attempt at achieving this by using a further additive in the form of a cationic fixative in addition to phenol formaldehyde and polyethylene oxide. Such further additives, however, cause further costs and work, for instance, in determining the correct dosage, dosing occasion and dosing place.

The present invention aims at obviating or decreasing the drawbacks of the prior-art technique and providing a simple agent and method for improving the retention when dewatering a cellulosic fibre suspension.

SUMMARY OF THE INVENTION

According to the present invention, it has surprisingly been found that the retention when dewatering a cellulosic fibre suspension can be further improved, compared with the use of a combination of phenol-formaldehyde resin and polyethylene oxide as retention agent, by using a combination of a modified phenol-formaldehyde resin and polyethylene oxide as retention agent, the modified phenol-formaldehyde resin containing cationic groups.

The invention thus provides a method of improving the retention when dewatering a cellulosic fibre suspension by adding to the suspension a retention agent, which comprises a phenol-formaldehyde resin and a polyethylene oxide, characterised in that a modified phenolformaldehyde resin containing cationic groups is added to the suspension.

The invention also provides a retention agent which comprises a phenol-formaldehyde resin and a polyethylene oxide, characterised in that the phenol-formaldehyde resin is a modified phenol-formaldehyde resin containing cationic groups.

Further features and advantages of the invention will appear from the following specification and the appended claims.

DETAILED DESCRIPTION OF THE INVENTION

As mentioned above, the retention agent according to the invention comprises a modified phenol-formaldehyde resin containing cationic groups. Apart from the amount of cationic groups, the inventive phenol-formaldehyde resin corresponds to conventional phenol-formaldehyde resins as used in retention systems in the pulp and paper industry. Thus the resin consists of a condensation product of phenol and formaldehyde and is preferably a resin of the resol type, i.e. a condensation product from the reaction between a phenol compound and an excess of formaldehyde. However, novolaks may also be used. Preferably, the resin is in the form of an aqueous solution when added as a retention agent.

The cationic groups included in the phenol-formaldehyde resin can be introduced either in the production of the phenol resin or by being added to the finished phenol-formaldehyde resin. There is no restriction to a special type of cationic group, but the cationic group preferably consists of an amine group, which may be derived from ammonia or be a primary, secondary or tertiary, amine. The amine group can possibly be linked to the phenol-formaldehyde resin by means of a link group. Preferred compounds for forming the cationic group are, inter alia, ethanol amine, n-propyl amine, dibutyl amine, triethyl amine and diethyl ethanol amine.

The cationicity, i.e. the amount of cationic groups in the phenol-formaldehyde resin is related to the anionic groups (phenol groups) which the phenol-formaldehyde resin normally contains. A cationicity of 0% means that the phenol-formaldehyde resin does not contain any cationic groups, but only the normal anionic phenol groups, the concentration of which usually amounts to about 24 microequivalents/g dry resin. A cationicity of 20% means that cationic groups have been introduced into the resin to an extent corresponding to 20% of the anionic groups, i.e. corresponding to about 5 microequivalents/g dry resin. Correspondingly, a cationicity of 35% means that the amount of cationic groups corresponds to about 8 microequivalents/g dry resin. In the invention, the cationicity of the modified phenol-formaldehyde resin preferably is about 5–85%. It is particularly preferred for the cationicity of the resin to be about 10–60%.

Regarding the determination of the cationicity of the phenol-formaldehyde resin, reference is made to the article by Lydia Bley, "Charge Titration for Selection and Dosage of Flocculants", March 1994, Mütek Application 1501-e, Mutek Analytic GmbH, Arzbergerstrasse 10, D-82211 Herrsching, Germany.

In addition to the above modification of the phenol-formaldehyde resin with cationic groups, the resin can also be modified with sulphur. Modification of phenol-formaldehyde resin with sulphur is per se known, and reference can be made to, for instance, A. Knop, L. A. Pilato; "Phenolic resins, Chemistry, Applications and Performance", Springer-Verlag, pp 152–153. As is evident from this reference, modification with sulphur causes a linking-together of the phenol rings with sulphur bridges containing one or more sulphur atoms.

In addition to the modified phenol-formaldehyde resin described above, the inventive retention agent comprises a polyethylene oxide as well. The polyethylene oxide used in the invention is of conventional type and preferably has a molecular weight in the range of about $0.5–20\times10^6$. Like the phenol-formaldehyde resin, the polyethylene oxide should be in the form of an aqueous solution when added as retention agent.

When used as a retention agent, the weight ratio of the modified phenol-formaldehyde resin to the polyethylene oxide can be varied within wide limits, but preferably the weight ratio of phenol-formaldehyde resin:polyethylene oxide is from about 1:5 to about 50:1. It is also preferred to use a greater part by weight of the modified phenol-formaldehyde resin than of the polyethylene oxide, i.e. it is particularly preferred that the weight ratio of phenol-formaldehyde resin:polyethylene oxide be in the range from about 1:1 to about 50:1. Most preferred the weight ratio is from about 2:1 to about 20:1.

The amount of retention agent which in the invention is added to the cellulosic fibre suspension is not critical, but is preferably such that the added polyethylene oxide content is about 10–1000 ppm, more preferred 25–200 ppm, most preferred 50–150 ppm, based on the dry content of the suspension. Contents below about 10 ppm are too low for a considerable improvement of the retention to be established, while contents above about 1000 ppm do not result in a further essential improvement of the retention and, moreover, result in undesirably high costs for the retention agent. Based on the polyethylene oxide content, the added amount of phenol-formaldehyde resin can be calculated on the basis of the weight ratio of phenol-formaldehyde resin to polyethylene oxide as above.

The sequence of adding to the cellulosic fibre suspension regarding the modified phenol-formaldehyde resin and the polyethylene oxide of the inventive retention agent is not critical, but it is preferred for the modified phenol-formaldehyde resin to be added before the polyethylene oxide. In papermaking in a papermaking machine, the addition preferably is carried out such that the polyethylene oxide is added to the stock immediately before the head box, and the modified phenol-formaldehyde resin is added to the stock just before the addition of the polyethylene oxide. More specifically, the polyethylene oxide is added at as late a stage as possible before the discharge of the stock from the head box and the forming thereof to a sheet so as to avoid that the polyethylene oxide is subjected to high shearing forces and is decomposed. However, at the same time the polyethylene oxide must after being added be distributed homogeneously in the suspension. As a rule, these conditions are best achieved if the polyethylene oxide is added immediately before the head box. Regarding the addition of the phenol-formaldehyde resin, this takes place, as mentioned above, preferably before the addition of the polyethylene oxide. The point of adding the phenol-formaldehyde resin is not critical, but it should be such that the phenol-formaldehyde resin has time to be distributed homogeneously in the suspension before the addition of the polyethylene oxide. Moreover, the addition of the phenol-formaldehyde resin can be carried out in such a manner that all the phenol-formaldehyde resin is added in one and the same point, or the addition can be distributed among two or more points after each other, seen in the feeding direction of the stock. The same applies to the addition of the polyethylene oxide.

As mentioned above, the invention aims at improving the retention when dewatering a cellulosic fibre suspension. Such a cellulosic fibre suspension preferably consists of a filler-containing suspension or stock for making paper, board or cardboard. The cellulose fibres in the suspension can be derived from different pulps, but are preferably derived from mechanical pulp, thermomechanical pulp (TMP), waste paper pulp or unbleached chemical pulp.

The filler in the cellulosic fibre suspension can consist of any conventional filler in the pulp and paper industry and is preferably selected among the group consisting of deposited aluminium silicates, silicates, deposited aluminium hydroxides, plastic pigments, calcium carbonate, clay, titanium dioxide and talc.

In addition to a filler, the cellulosic fibre suspension may contain further additives, which are conventional in the pulp and paper industry.

In order to further facilitate the understanding of the invention, some illustrative, but non-limiting Examples will be stated below.

EXAMPLES

All experiments were carried out in a so-called Britt Jar (BDDJ) supplied by Paper Research Materials Inc in Syracuse, USA, provided with 75 mesh wire (60 M). The equipment is described in TAPPI Test Method T 261 cm-90. When required, the pulp was diluted with tap water. The dry content, pH and temperature of the stock were adjusted to the conditions in the papermaking machine involved. Fully-diluted stock was preheated to the correct temperature and its pH was adjusted before use.

In each BDDJ experiment, use was made of 500 ml of stock. The chemicals were added (diluted to 15–20 ml) during agitation at 1000 rpm. The resin was added 20 s before the polyethylene oxide (PEO), whereupon the bottom valve was opened immediately. The first 25 ml of filtrate were rejected, and the total retention and the filler retention, respectively, were determined on the following 100 ml. The total retention was calculated from the ratio of the amount of suspended substances in the filtrate according to SCAN testing method C17:64 (paper filter No. 3) to the dry solids content of the stock, DS (the retention expressed in %=(1-(suspended substances/DS)) ×100). The filler retention is determined in a similar manner on the basis of the ratio of the ash content of the filtrate to that of the stock according to SCAN testing method C6:62. The dewatering is determined in the same apparatus by measuring the time for drainage of the subsequent 280 ml of filtrate.

The polyethylene oxide (PEO) was the same in all experiments and had a molecular weight of $7\times10^6$, a density of 1210 kg $m^3$ and a viscosity in 1% aqueous solution at 25° C. of 6000–10000 cP.

The phenol-formaldehyde resin (conventional resin) as used in the Examples for comparison was a phenol-formaldehyde resin of conventional type and without cationic groups. The phenol-formaldehyde resin was prepared by charging 426 g phenol, 200 g 46% sodium hydroxide solution and 400 g water into a 2 litre glass flask and heating the mixture to about 100° C. Subsequently, 524 g 50% formalin were added during about 20 min and during cooling since the reaction was exothermal. The temperature of the reaction solution was reduced to about 85° C. by cooling, and the reaction was allowed to proceed about 25 min more. After checking that the reaction was complete, the mixture was cooled and 58 g 46% sodium hydroxide solution and 300 g water were added to the mixture. The prepared phenol-formaldehyde resin had a cationicity of 0%, determined as described above.

The modified phenol-formaldehyde resins used in the Examples and having cationic groups (the inventive resin) were of the type described above. The preparation of the resin and its. cationicity are defined in the Examples. The percentages, except the cationicity, relate to weight, unless otherwise stated.

Preferably, the modified phenol-formaldehyde resin as used in the invention is a modified resol resin. Such a resin can be prepared by a reaction between phenol and/or a substituted phenol and formaldehyde in a molar ratio of 1:1 to 1:3.5, preferably 1:2.0 and a temperature of 40–100° C., preferably 50–90° C. at atmospheric pressure or at a sub-atmospheric pressure at a correspondingly lower temperature and at a pH higher than 8. The reaction is effected in aqueous solution in the presence of ammonia, a primary, secondary or tertiary amine or a mixture of two or more such compounds as combined catalyst and reactant for introduction of latent cation-active amino groups in the resol resin, the reaction being carried on so far that a resin having a high molecular weight and a cationicity of 5–85%, preferably 10–60% is obtained, whereupon the resin is treated with an aqueous solution of sodium hydroxide, potassium hydroxide or calcium hydroxide, which results in a resin solution which at a pH lower than about 7 can be precipitated in the form of small particles.

The formaldehyde is then added preferably as formalin containing about 30–35% by weight formaldehyde.

Normally the phenol is first heated together with the amine, whereupon the formaldehyde is added successively.

If a substituted phenol is used, this suitably consists of cresol or alkylphenol such as nonylphenol.

The reaction is advantageously carried on so far that at least the major portion, but preferably the entire amount of monomer is consumed.

Even if, as mentioned above, it is possible to mix the amine compound in the finished resin and thus achieve a certain cationicity of the resin, it is preferred according to the invention to react the amine in the resin during the preparation thereof.

As mentioned above, also a novolak resin can be used, and an example of the preparation of such a resin is as follows. 470.55 g phenol, 46.86 g diethyl ethanol amine and 225.22 g 50% aqueous solution of formaldehyde are charged into a 2 litre glass flask and heated to about 100° C. The reaction is allowed to proceed for 5.5 h at the same temperature. Then 260.4 g 46% sodium hydroxide solution and 1552.4 g water are added. The resulting product is a dissolved novolak resin with a molar ratio of phenol:formaldehyde:diethyl ethanol amine of 1:0.75:0.110. The cationicity of the resulting novolak resin is 27%, calculated in the way as described above.

Example 1

In this Example, an experiment was made with the conventional resin described above and a resin according to the invention which was prepared as follows.

426 g phenol and 51.1 g tertiary amine (diethyl ethanol amine) were charged into a 2 litre glass flask and heated to about 75° C. Then 524 g 50% formalin were charged during about 20 min and during cooling since the reaction was exothermal. After increasing the temperature of the reaction solution to about 100° C., the reaction was allowed to proceed about 25 min more. After checking that the reaction was complete, the mixture was cooled and 258 g 46% sodium hydroxide solution and 700 g water were added to the mixture. The cationicity of the resulting phenol-formaldehyde resin was 20%, calculated in the way as described above.

The experiment was carried out according to the above description on dried thermomechanical pulp (TMP) of softwood. The pulp was slushed in tap water and ground to about 90° SR. Then 15% filler (calcined clay) was added. The dry solids content after diluting was 0.99%, the pH 5.0 and the temperature 50° C. The results are shown in Table 1.

TABLE 1

| Resin | PEO ppm | Quota resin /PEO | Total retention % | Filler retention % | Dewatering time s/280 ml |
|---|---|---|---|---|---|
| — | — | — | 50.3 | 9,2 | 80 |
| Conventional resin | 50 | 5 | 59.1 | 30.1 | 83 |
| Resin according to the invention, 20% cationicity | 50 | 5 | 60.7 | 32.2 | 88 |
| Conventional resin | 125 | 5 | 72.6 | 59.1 | 88 |
| Resin according to the invention, 20% cationicity | 125 | 5 | 76.2 | 65.7 | 77 |

As appears from the results in Table 1, both the filler retention and the total retention were improved when using the retention agent with the modified phenol-formaldehyde resin according to the invention. When adding a larger amount of retention agent, also the dewatering time was improved.

Example 2

In this Example, an experiment was carried out with a conventional resin as stated above as well as with a modified formaldehyde resin according to the invention, which was prepared in the following manner.

426 g phenol and 19.2 g tertiary amine (diethyl ethanol amine) were charged into a 2 litre glass flask and heated to about 75° C. Then 524 g 50% formalin were charged during about 20 min and during cooling since the reaction was exothermal. The temperature of the reaction solution was increased to about 100° C., and then the reaction was allowed to proceed for about 25 min more. After checking that the reaction was complete, the mixture was cooled and 258 g 46% sodium hydroxide solution and 700 g water were added to the mixture. The cationicity of the prepared phenol-formaldehyde resin was 37%, calculated in the manner as described above.

The experiment was carried out according to the description above on a stock from the head box of a papermaking machine, said stock consisting of 30% TMP, 32% broke and 38% recycled fibre. The dry solids content was 0.79% and the temperature 39° C. The results are shown in Table 2.

TABLE 2

| Resin | PEO ppm | Quota resin/PEO | Total retention % |
|---|---|---|---|
| — | — | — | 47.7 |
| Conventional resin | 100 | 4 | 53.9 |
| Resin according to the invention, 37% cationicity | 100 | 4 | 56.3 |
| Conventional resin | 100 | 6 | 54.3 |
| Resin according to the invention, 37% cationicity | 100 | 6 | 57.1 |

As appears from the results in Table 2, the total retention was improved when using the modified phenol-formaldehyde resin according to the invention compared with a conventional phenol-formaldehyde resin. The modified phenol-formaldehyde resin in this Example differed from the modified phenol-formaldehyde resin in Example 1 owing to a higher cationicity (37% instead of 20%).

Example 3

In this Example an experiment was carried out with a conventional resin, as described above, and a modified formaldehyde resin which was prepared in the following manner.

426 g phenol and 77.1 g tertiary amine (diethyl ethanol amine) were charged into a 2 litre glass flask and heated to about 75° C. Then 524 g 50% formalin were charged during about 20 min and during cooling since the reaction was exothermal. After increasing the temperature of the reaction solution to about 100° C, the reaction was allowed to proceed about 25 min more. After checking that the reaction was complete, the mixture was cooled and 258 g 46% sodium hydroxide solution and 700 g water were added to the mixture. The cationicity of the prepared phenol-formaldehyde resin was 28%, calculated in the manner as described above.

The experiment was carried out according to the above description on a stock from the head box of a papermaking machine, said stock consisting of 100% TMP of softwood with 0.92% dry solids content. The results are shown in Table 3.

TABLE 3

| Resin | PEO ppm | Quota resin/PEO | Total retention % |
|---|---|---|---|
| — | — | — | 40.0 |
| Conventional resin | 50 | 5 | 46.3 |
| Resin according to the invention, 28% cationicity | 50 | 5 | 47.9 |
| Conventional resin | 100 | 5 | 53.6 |
| Resin according to the invention, 28% cationicity | 100 | 5 | 56.5 |

As appears from the results in Table 3, the total retention was improved when using the modified phenol-formaldehyde resin according to the invention, compared with the use of a conventional phenol-formaldehyde resin.

Example 4

In this Example an experiment was carried out with a conventional resin as described above, and a modified formaldehyde resin according to Example 3.

The experiment was carried out according to the above description on a stock from the head box of a papermaking machine, said stock consisting of TMP of softwood with 10% filler added, which consisted of a sodium aluminium silicate under the tradename Zeolox and of the chemical formula $Na_2O.Al_2O_3.10–13, 4SiO_2.H_2O$.

The dry solids content of the stock was 1.02%. The results are shown in Table 4.

TABLE 4

| Resin | PEO ppm | Quota resin/PEO | Total retention % | Filler retention % |
|---|---|---|---|---|
| — | — | — | 39.0 | 0 |
| Conventional resin | 100 | 5 | 51.5 | 8.3 |
| Resin according to the invention, 20% cationicity | 100 | 5 | 54.6 | 12.3 |

As appears from the results in Table 4, both the filler retention and the total retention were improved when using the modified phenol-formaldehyde resin according to the invention compared with the use of a conventional formaldehyde resin.

Example 5

In this Example, an experiment was carried out with a conventional resin as described above and a cation-modified, sulphur-containing resin according to the invention, which was prepared in the following manner.

A phenol-sulphur precondensate was prepared by reacting together, at a temperature of 115° C., 4.53 mole (426 g) phenol and 1.69 mole (54 g) sulphur in the presence of sodium hydroxide in aqueous solution as a catalyst. The above precondensate and 77.1 g tertiary amine (diethyl ethanol amine) were charged into a 2 litre glass flask and heated to about 75° C. Then 524 g 50% formalin were charged during about 20 min and during cooling since the reaction was exothermal. After increasing the temperature of the reaction solution to about 100° C., the reaction was allowed to proceed about 15 min more. After checking that the reaction was complete, the mixture was cooled and 46% sodium hydroxide solution and water were added such that the amount of 46% sodium hydroxide solution in the mixture corresponded to 258 g and the amount of water corresponded to a total addition of 700 g. The prepared sulphur-containing phenol-formaldehyde resin according to the invention had a cationicity of 10%, measured in the manner described above.

The experiments with the above resins were carried out according to the description above on a stock which consisted of dried TMP of tropical softwood. The pulp had been slushed in tap water and ground to about 90° SR. The dry solids content after diluting was 1.05%, the pH was 5.0 and the temperature was 50° C. The results are shown in Table 5.

TABLE 5

| Resin | PEO ppm | Quota resin/PEO | Total retention % | Dewatering time s/280 ml |
|---|---|---|---|---|
| — | — | — | 52.9 | 99 |
| Conventional resin | 125 | 5 | 78.0 | 97 |
| Sulphur-containing resin according to the invention, 10% cationicity | 125 | 5 | 81.7 | 109 |
| Conventional resin | 200 | 8 | 85.2 | 70 |
| Sulphur-containing resin according to the invention, 10% cationicity | 200 | 8 | 88.4 | 86 |

As appears from the results in Table 5, the total retention was improved when using the sulphur-containing, modified phenol-formaldehyde resin according to the invention, compared with the use of a conventional formaldehyde resin. The dewatering time increased somewhat.

Example 6

In this Example, experiments were carried out with a conventional resin as described above and a sulphur-containing, modified phenol-formaldehyde resin according to the invention, which was prepared as described in Example 5.

The experiments with the conventional resin and the sulphur-containing resin according to the invention were carried out according to the above description on a stock which consisted of dry TMP of softwood which had been slushed in tap water and ground to about 90° SR. Then 15% filler (calcined clay) was added. The dry content after diluting was 0.96%, the pH was 5.0 and the temperature was 50° C. The results are shown in Table 6.

TABLE 6

| Resin | PEO ppm | Quota resin/PEO | Total retention % | Filler retention % | Dewatering time s/280 ml |
|---|---|---|---|---|---|
| — | — | — | 51.9 | 5.8 | 84 |
| Conventional resin | 200 | 4 | 82.9 | 75.8 | 71 |
| sulphur-containing resin according to the invention, 10% cationicity | 200 | 4 | 84.3 | 78.4 | 86 |
| Conventional resin | 200 | 10 | 85.1 | 79.5 | 55 |
| Sulphur-containing resin according to the invention, 10% cationicity | 200 | 10 | 86.8 | 83.4 | 58 |

As appears from the results in Table 6, both the filler retention and the total retention were improved when using the sulphur-containing, modified phenol-formaldehyde resin according to the invention, compared with the use of a conventional formaldehyde resin. However, the dewatering time increased somewhat.

Example 7

In this Example, experiments were carried out with different modified phenol-formaldehyde resins according to the invention. The modified, cationic group consisted of ammonium ($NH_4$), primary amine, secondary amine, or tertiary amine. The modified formaldehyde resins were prepared as follows Cation Type: $NH_4$ 552 g phenol and 200 g ammonia were charged into a 2 litre glass flask. The content was cautiously heated to about 75° C. During agitation and controlled cooling, 678 g methanol-free 50% formalin were successively added during a time of about 25 min. The reaction was exothermal. After about 30 min the reaction temperature was increased to 85° C. When the phenol polymer had achieved such a high molecular weight as to be insoluble in water and was precipitated, the reaction mixture was cooled, and 310 g 46% sodium hydroxide solution were added to make the resulting resol resin formed fully water-soluble. Besides, 275 g water were added. The cationicity of the prepared phenol-formaldehyde resin was 27%, measured in the way as described above.

Cation Type: Primary Amine 446 g phenol and 51 g of a primary amine (n-propylamine) were charged into a 2 litre glass flask. After heating to about 75° C., 524 g 50% formaldehyde were successively added. After about 0.5 h the reaction temperature was allowed to rise to 100° C. The reaction was allowed to proceed until a precipitation of a reaction product, insoluble in water, was obtained in the flask and the reaction of the reactants included was completed. After cooling, 343 g 46% sodium hydroxide solution and 700 g water were added. The prepared phenol-formaldehyde resin had a cationicity of 40%, measured in the way as described above.

Cation Type: Secondary Amine 426 g phenol and 110 g secondary amine (dibutyl amine) were charged into a 2 litre glass flask and heated to about 75° C. Then 524 g 50% formalin were charged during about 15 min and during cooling since the reaction was exothermal. After increasing the temperature of the reaction solution to about 100° C., the reaction was allowed to proceed about 25 min more. A phase partition of the content of the flask had then occurred. After checking that the reaction was complete, the mixture was cooled and 258 g 46% sodium hydroxide solution and 700 g water were added to the mixture. The cationicity of the prepared phenol-formaldehyde resin was 36%, measured in the way as described above.

Cation Type: Tertiary Amine 1

426 g phenol and 87 g tertiary amine (triethyl amine) were charged into a 2 litre glass flask and heated to about 75° C. Then 524 g 50% formalin were charged during about 20 min and during cooling since the reaction was exothermal. After increasing the temperature of the reaction solution to about 100° C., the reaction was allowed to proceed about 25 min more. After checking that the reaction was complete, the mixture was cooled and 258 g 46% sodium hydroxide solution and 700 g water were added to the mixture. The cationicity of the prepared phenol-formaldehyde resin was 42%, measured in the manner described above.

Cation Type: Tertiary Amine 2

426 g phenol and 200 g tertiary amine (diethyl ethanol amine) were charged into a 2 litre glass flask and heated to about 75° C. Then 524 g 50% formalin were charged during about 20 min and during cooling since the reaction was exothermal. After increasing the temperature of the reaction solution to about 100° C., the reaction was allowed to proceed about 25 min more. After checking that the reaction was complete, the mixture was cooled and 258 g 46% sodium hydroxide solution and 700 g water were added to the mixture. The cationicity of the prepared phenol-formaldehyde resin was 28%, measured in the way as described above.

The experiments with the above described, modified phenol-formaldehyde resins according to the invention were carried out on dried TMP of softwood pulp, which had been slushed in tap water and ground to about 90° SR, whereupon 15% filler (calcined clay) was added. The dry solids content after diluting was 0.96%, the pH was 5.0 and the temperature was 50° C. The results are shown in Table 7.

TABLE 7

| Resin | Cation type | PEO ppm | Quota resin/PEO | Total retention % | Filler retention % | Dewatering time s/280 ml |
|---|---|---|---|---|---|---|
| — | — | — | — | 50.2 | 6.1 | 80 |
| Resin according to the invention, 27% cationicity | $NH_4$ | 200 | 8 | 75.0 | 63.7 | 83 |
| Resin according to the invention, 4O% cationicity | prim. amine | 200 | 8 | 81.6 | 74.6 | 62 |
| Resin according to the invention, 36% cationicity | sec. amine | 200 | 8 | 68.5 | 52.1 | 85 |
| Resin according to the invention, 42% cationicity | tert. amine 1 | 200 | 8 | 54.4 | 23.3 | 75 |
| Resin according to the invention, 28% cationicity | tert. amine 2 | 200 | 8 | 62.3 | 38.1 | 88 |

As appears from the results in Table 7, the modified resin according to the invention which contained a modifying cation of the primary amine type yielded both the best filler retention and the best total retention. Moreover, this resin resulted in the shortest dewatering time.

Example 8

In this Example, experiments were made with the conventional resin described above and a resin according to the invention, which was prepared in accordance with that stated in Example 2. The experiments concerned the production of sheets of paper for testing paper properties.

In each experiment, 5 sheets were prepared. For each sheet, use was made of 500 ml stock of a non-dried thermomechanical pulp (TMP), which had been slushed in water, defibrated and adjusted in respect of pH. The dry solids content after diluting with tap water was 2.44 g/l and the pH was 5.5. The stock was introduced into a so-called Britt Jar (BDDJ) supplied by Paper Research Materials Inc., Syracuse, USA, with a stationary base plate. Retention agent chemicals consisting of phenol-formaldehyde resin and polyethylene oxide were mixed in the stock during agitation at 1000 rpm. The resin was added 20 s before the polyethylene oxide (PEO). 15 s after completion of the adding of chemicals, the stock was transferred to a round sheet form of SCA model (supplied by AB Lorentzen & Wettre, Stockholm) with a diameter of 16.5 cm for preparing sheets according to SCAN C 26:76. The sheets prepared were dewatered and pressed by applying 400 kN for 5 min and dried in a rotary drier at 60° C. for 2 h. After conditioning of the sheets for at least 12 h at 23° C. and 50% RH, the tensile strength was determined according to SCAN P44:81 and the tearing resistance according to SCAN P 11:73.

The results obtained are stated in Table 8. As appears from Table 8, both the tensile strength and the tearing resistance of the paper prepared were improved when using the modified phenol-formaldehyde resin according to the invention compared with a conventional phenol-formaldehyde resin.

TABLE 8

| Resin | PEO ppm | Quota resin/PEO | Tear index $Nm^2/kg$ | Tensile index kNm/kg |
|---|---|---|---|---|
| Conventional resin | 50 | 10 | 4.79 | 15.33 |

TABLE 8-continued

| Resin | PEO ppm | Quota resin/PEO | Tear index $Nm^2/kg$ | Tensile index kNm/kg |
|---|---|---|---|---|
| Resin according to the invention, 37% cationicity | 50 | 10 | 5.07 | 17.57 |
| Conventional resin | 100 | 7 | 4.60 | 14.06 |

TABLE 8-continued

| Resin | PEO ppm | Quota resin/PEO | Tear index $Nm^2/kg$ | Tensile index kNm/kg |
|---|---|---|---|---|
| Resin according to the invention, 37% cationicity | 100 | 7 | 4.94 | 15.62 |

Example 9

The experiment according to Example 8 was repeated, but using a stock of unbleached sulphate pulp, which was slushed in tap water, defibrated and ground to about 20° SR. The dry solids content of the stock after diluting was 3.0 g/l and its pH was 5.0. Moreover, as modified phenol-formaldehyde resin according to the invention, use was made of on the one hand a resin with 37% cationicity according to Example 2 and, on the other hand, a resin with 28% cationicity according to Example 7 (cation type:tertiary amine 2). In the experiments, the tensile index of the prepared test sheets was determined according to SCAN P 44:81.

The results obtained are stated in Table 9. As appears from Table 9, the use of the modified phenol-formaldehyde resins according to the invention yields an improved tensile strength of the paper compared with the use of a conventional phenol-formaldehyde resin.

TABLE 9

| Resin | PEO ppm | Quota resin/PEO | Tensile index kNm/kg |
|---|---|---|---|
| Conventional resin | 50 | 2 | 65.73 |
| Resin according to the invention, 28% cationicity | 50 | 2 | 68.72 |
| Resin according to the invention, 37% cationicity | 50 | 2 | 69.14 |
| Conventional resin | 200 | 10 | 61.65 |
| Resin according to the invention, 28% cationicity | 200 | 10 | 64.85 |
| Resin according to the invention, 37% cationicity | 200 | 10 | 71.25 |

What is claimed is:

1. A method of dewatering a cellulosic fibre suspension, the method comprising the steps of:

adding to the suspension a retention agent comprising a phenol-formaldehyde resin and a polyethylene oxide; and dewatering the suspension, wherein the improvement comprises that the phenol-formaldehyde resin is a modified phenol-formaldehyde resin containing cationic groups, and a weight ratio of modified phenol-formaldehyde resin to polyethylene oxide is from about 1:5 to 50:1.

2. A method as claimed in claim 1, characterised by adding to the suspension a modified phenol-formaldehyde, resin containing amine groups.

3. A method as claimed in claim 1, characterised by first adding to the suspension the modified phenol-formaldehyde resin and then the polyethylene oxide.

4. A method as claimed in claim 1, characterised in that the modified phenol-formaldehyde resin has a cationicity of about 5–85%.

5. A method as claimed in claim 1, characterised in that the polyethylene oxide has a molecular weight of about $0.5–20\times10^6$.

6. A method as claimed in claim 1, characterised in that the polyethylene oxide is added to the suspension in an amount of about 10–1000 ppm, based on the dry solids content of the suspension.

7. A retention agent for dewatering a cellulosic fibre suspension, the retention agent comprising a phenol-formaldehyde resin and a polyethylene oxide, wherein the improvement comprises that the phenol-formaldehyde resin is a modified phenol-formaldehyde resin containing cationic groups, and a weight ratio of modified phenol-formaldehyde resin to polyethylene oxide is from about 1:5 to 50:1.

8. A retention agent as claimed in claim 7, characterised in that the phenol-formaldehyde resin contains cationic amine groups.

9. A retention agent according to claim 7, characterised in that the modified phenol-formaldehyde resin has a cationicity of about 5–85%.

10. The method as claimed in claim 1, further comprising the steps of:

placing the cellulosic fiber suspension into a head box; and discharging the cellulosic fiber suspension from the head box to form a sheet, wherein the modified phenol-formaldehyde resin and polyethylene oxide are added to the cellulosic fiber suspension before the step of placing the cellulosic fiber suspension into the head box.

11. The method as claimed in claim 10, wherein the modified phenol-formaldehyde resin is added before the polyethylene oxide.

12. The method as claimed in claim 1, wherein the cellulosic fiber suspension contains a filler comprising at least one selected from the group consisting of deposited aluminum silicates, silicates, deposited aluminum hydroxides, plastic pigments, calcium carbonate, titanium dioxide and talc.

13. The method as claimed in claim 1, wherein the phenol-formaldehyde resin is formed by reacting a phenol, a tertiary amine and formalin.

14. The method according to claim 13, wherein the tertiary amine is diethyl ethanol amine.

* * * * *